US005288004A

United States Patent [19]

Johnsson et al.

[11] Patent Number: 5,288,004

[45] Date of Patent: Feb. 22, 1994

[54] MAGAZINE FOR APPARATUS FOR EJECTING FASTENERS

[75] Inventors: Nils Johnsson, Axvall; Börje Eriksson, Hjo, both of Sweden

[73] Assignee: Joset Kihlberg AB, Hjo, Sweden

[21] Appl. No.: 937,892

[22] PCT Filed: Apr. 19, 1991

[86] PCT No.: PCT/SE91/00279

§ 371 Date: Oct. 16, 1992

§ 102(e) Date: Oct. 16, 1992

[87] PCT Pub. No.: WO91/16177

PCT Pub. Date: Oct. 31, 1991

[30] Foreign Application Priority Data

Apr. 26, 1990 [SE] Sweden ..... 9001499-4

[51] Int. Cl.[5] ..... B25C 5/16

[52] U.S. Cl. ..... 227/109; 227/120

[58] Field of Search ..... 227/109, 120, 127

[56] References Cited

U.S. PATENT DOCUMENTS 2,368,552 1/1945 La Place .

4,369,909 1/1983 Grzeika ..... 227/109

4,749,115 6/1988 Fehrs .

5,005,750 4/1991 Scala ..... 227/109

FOREIGN PATENT DOCUMENTS 2063754 6/1981 United Kingdom .

*Primary Examiner*—Scott Smith

[57] ABSTRACT

An apparatus for ejecting fasteners from a magazine by an impact member. The magazine includes an adjustment device for selective adaptation of the magazine to fasteners of a plurality of predetermined lengths. The adjustment device has a body which is rotatable about a longitudinal axis and fixable in at least two positions. The body has two or more longitudinally extending slots, each of different depth, for accommodating a portion of the fasteners. The slots are arranged in the cylindrical body such that when each slot si aligned with a row of fasteners, the longitudinal axis of the cylindrical body is offset from the row of fasteners in a manner such that the longitudinal axis of the cylindrical body does not lie directly above the row of fasteners.

10 Claims, 4 Drawing Sheets

MAGAZINE FOR APPARATUS FOR EJECTING FASTENERS

TECHNICAL FIELD

The present invention relates to a magazine for an apparatus for ejecting fasteners from the magazine through a nozzle by means of an impact member striking an impact region of said fasteners, wherein the fasteners are arrangeable in a row in a longitudinally extending feed channel, said magazine comprising an adjustment device for optional adaptation of the magazine to fasteners of a plurality of predetermined lengths, said adjustment device comprising a preferably cylindrical body rotatable about its longitudinal axis and fixable in at least two positions, said body presenting two or more longitudinally extending slots or cut-outs, each of differing depth, for accommodating a portion of the present fasteners, whereby said body is adapted to be rotated to a position in which the desired slot or cut-out is aligned with the row of fasteners, whereat said portion of the fasteners lies adjacent the base surface of the slot.

BACKGROUND

Apparatus of the above-mentioned type is usually pneumatically, electrically or spring powered and is used for ejecting different types of fasteners, such as nails, staples or brads. The apparatus's magazine is, however, adapted to one sort of the above-mentioned types of fasteners. The most common type of apparatus includes a magazine which is normally charged with a plurality of fasteners, often joined together in a so called strip, which are inserted in a feed channel, whereat a spring-biased pusher feeds the fasteners on demand to a discharge opening. With magazines intended for certain types of fasteners, for example in the form of brads, it is usual for the magazine to be constructed so as to be able to take fasteners of various predetermined lengths. Apparatus presently on the market are hereby usually adjustable in three different positions.

According to a previously known solution, said adjustment is achieved by means of a guide for the impact region of the fasteners being displaceable in the direction of ejection of the fasteners to a plurality of fixed positions adapted to fasteners of certain predetermined lengths. The rear guide is hereby moved back and forth between its various positions by way of the introduction of two pins or screws through one side surface of the magazine into cooperating holes provided in the guide, wherein each hole corresponds to a predetermined position. The disadvantage with such a construction is that a two-handed grip is required for adjustment of the guide.

Another known method for displacing the guide between predetermined positions presents an eccentric member controlable from the side surface of the magazine which runs in a longitudinally extending groove in the guide, whereby the guide can be displaced in the direction of ejection of the fasteners.

A problem with these types of magazines is that the manual adaptation of the magazine to fasteners of differing lengths often gives the impression to the user of being very time-consuming.

A magazine of the type mentioned in the introduction of the description is disclosed in GB-A-2 063 754. In said document, the adjustment device is in the form of a substantially cylindrical longitudinally extending rotatable body having slots or cut-outs to accomodate different sized glazier's points. The axis of rotation of the rotatable body lies directly above, and parallel to, the feed channel for the glazier's points. Accordingly, it is not possible to provide a slot or cut-out in the rotatable body which is deeper than the radius of said rotatable body, thereby restricting the range of sizes of the fasteners which can be used.

OBJECT OF THE INVENTION

The object of the present invention is to overcome the above mentioned problem by providing a magazine for and apparatus of the type mentioned in the introduction whereby the magazine can be adapted in a simple manner to fasteners of greatly differing lengths.

SUMMARY OF THE INVENTION

The above mentioned object is achieved according to the invention by providing a magazine for an apparatus for ejecting fasteners from the magazine through a nozzle by means of an impact member striking an impact region of said fasteners, wherein the fasteners are arrangeable in a row in a longitudinally extending feed channel, said magazine comprising an adjustment device for optional adaptation of the magazine to fasteners of a plurality of predetermined lengths, said adjustment device comprising a preferably cylindrical body rotatable about its longitudinal axis and fixable in at least two positions, said body presenting two or more longitudinally extending slots or cut-outs, each of differing depth, for accommodating a portion of the present fasteners, whereby said body is adapted to be rotated to a position in which the desired slot or cut-out is aligned with the row of fasteners, whereby said portion of the fasteners lies adjacent the base surface of the slot. The invention is characterized in that said rotatable body is arranged parallel to, though offset from, the row of fasteners.

By positioning the rotatable body non-axially with the row of fasteners, slots or cut-outs significantly deeper than the radius of the rotatable body can be provided in the body without unduly compromising the strength of the body. In this way a more compact arrangement can be provided.

In a preferred embodiment, said portion comprises the impact region of the fasteners.

A suitable embodiment is further characterized in that said body is displaceable in its longitudinal direction by means of said operating member for engagement with, and releasing from, a position-determining member, whereby said releasing allows said rotation of the body.

In an advantageous embodiment, said position-determining member further comprises a position-determining casing presenting a plurality of positioning grooves arranged so as to fix said body in a position in which the desired slot is aligned with the ejection direction of the fasteners when it accommodates a pin which is transversely affixed in the body.

In a suitable embodiment, said body is substantially cylindrical.

The magazine is preferably intended for fasteners which are in the form of a brad having a sharpened nose region and a cross-cut impact region against which said impact member strikes during ejection of the brad. In an embodiment adapted for today's market, said slots in the body are three in number.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described in more detail in the following by way of example, with reference to the attached drawings in which the same figure reference numerals in the different figures relate to corresponding and which drawings are given by way of illustration only, and thus are not limitative of the present invention.

DETAILED DESCRIPTION OF THE PREFERRED EMBODIMENTS

Figure 1:
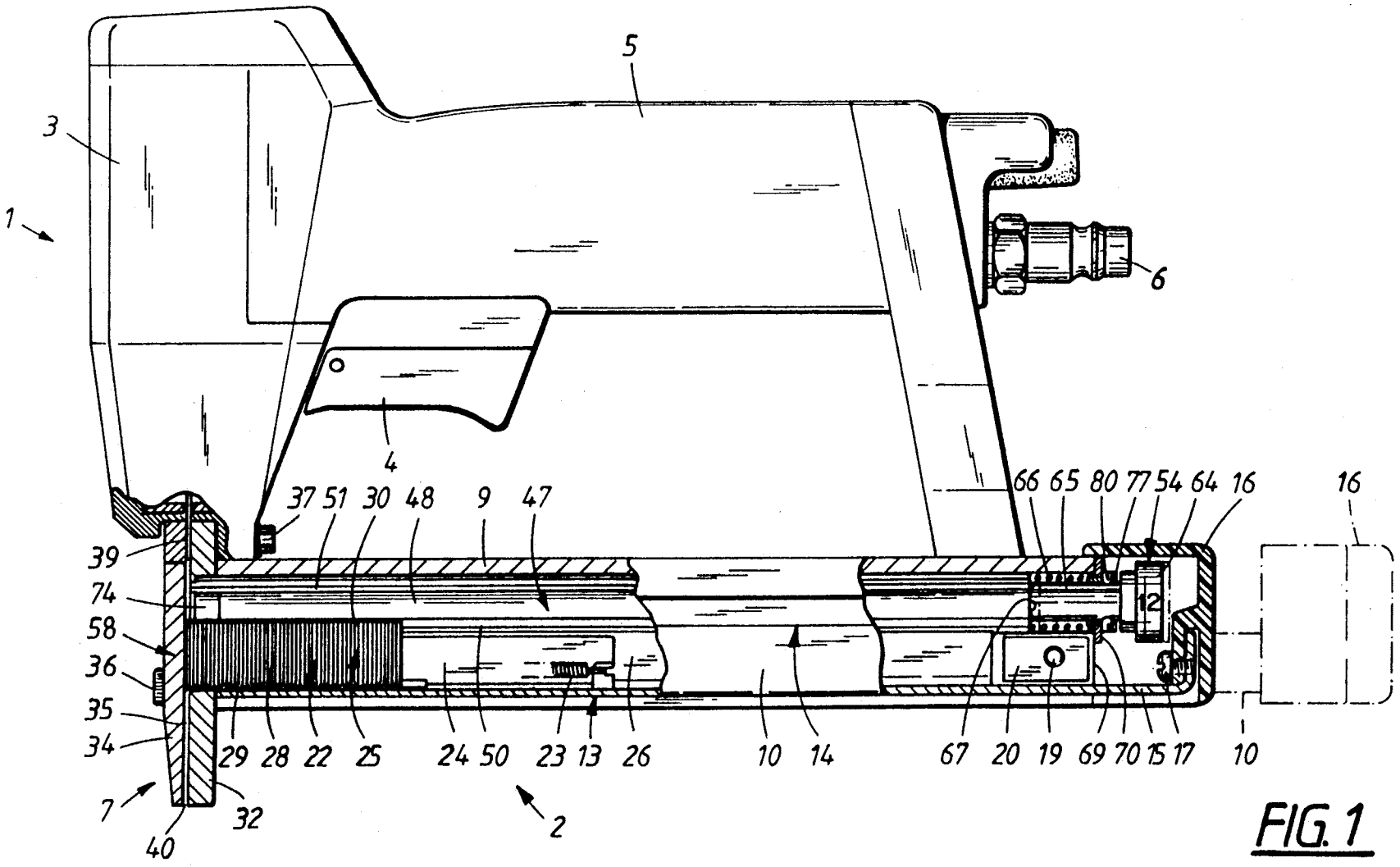
FIG. 1 shows a partial sectional view along line I—I in FIG. 2 of an apparatus with a magazine according to the invention.

The invention will be described in the following using an embodiment including a pneumatically driven nailing apparatus which is denoted in FIG. 1 with the reference numeral 1 and which comprises a magazine which is generally indicated with figure reference numeral 2.

The apparatus further includes a cylinder housing 3, a trigger 4, a handle 5, a compressed-air inlet 6 and an ejector nozzle 7 positioned in front of said cylinder housing 3.

More accurately, the magazine consists of a magazine housing 9 of extruded aluminium and a magazine cover 10 displaceable in the longitudinal direction of the magazine 2 and being in the form of a substantially right-angled steel plate, whose end portions 11 and 12 run along grooves 13 and 14. The magazine cover 10 is provided at its end region 15 remote from the ejector nozzle with an end piece 16 of suitable plastic material. The end piece 16 is affixed to the magazine cover 10 with an internal screw 17. The magazine cover 10 is displaceable between a closed position which is shown in FIG. 1 and an opened position in which the magazine cover 10 is drawn out so that the magazine's 2 interior is accessible. The magazine cover 10 is hereby shown in FIG. 1 in a partially opened position by dotted lines. The magazine cover 10 is locked in its opened and closed positions respectively by means of a spring biased peg 19 held in a spring housing 20 arranged in the magazine's 2 free end.

For loading of the magazine 2, the magazine cover 10 is drawn to its open position by means of the end piece 16, whereat fasteners 22 joined in a so called "strip" are placed in a longitudinally extending feed channel 25 laterally delimited by longitudinally extending guide rails 26. Once the fasteners 22 have been placed in the feed channel 25, the magazine cover 10 is moved to its closed position and locked thereat by means of the peg 19 being projected through spring force into a not shown hole in said cover 10. The fasteners are hereby brought into contact with a spring-tensioned 23 fastener pusher 24 which, concurrently with the firing of the apparatus, feeds the fasteners 22 to the firing position in the ejector nozzle 7.

The fasteners 22 shown in the figures are in the form of brads 28 which present a sharpened nose region 29 and a cross-cut impact region 30 without a so called head.

As can be seen in FIG. 1, the nozzle 7 is formed with a rear nozzle plate 32 on the feed side 58 of the magazine 2 and a front nozzle plate 34 positioned at the magazine's feed side 58 and which plates together form a narrow ejector passage 35. The two nozzle plates 32, 34 are affixed to each other and to the rest of the apparatus 1 by means of screws 36, 37 respectively.

Figure 3:
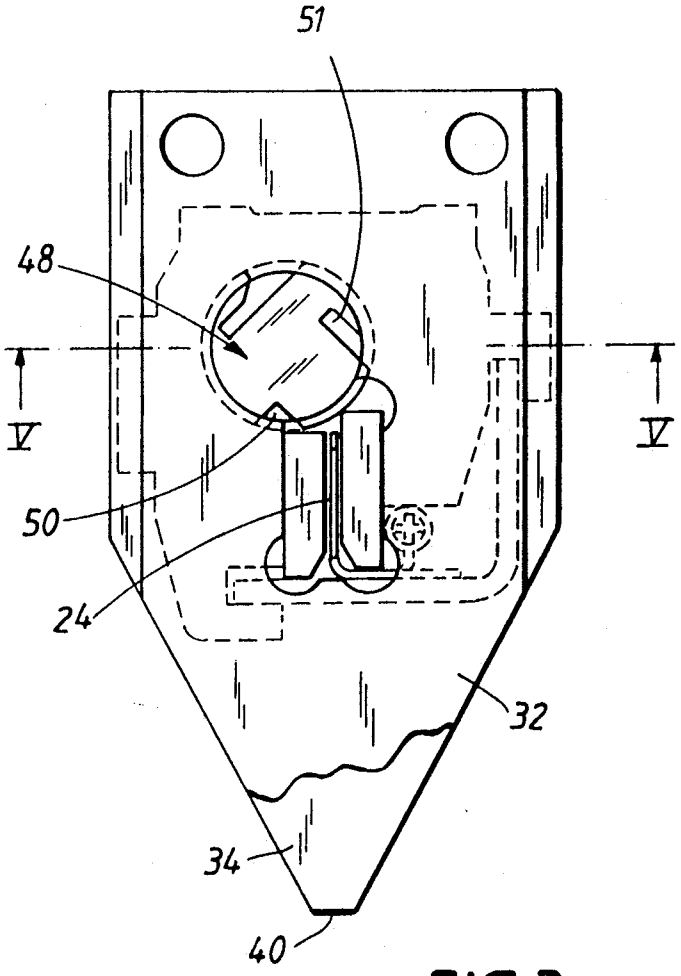
FIG. 3 shows the same magazine from the front, though with the adjustment device shown during rotation.
Figure 2:
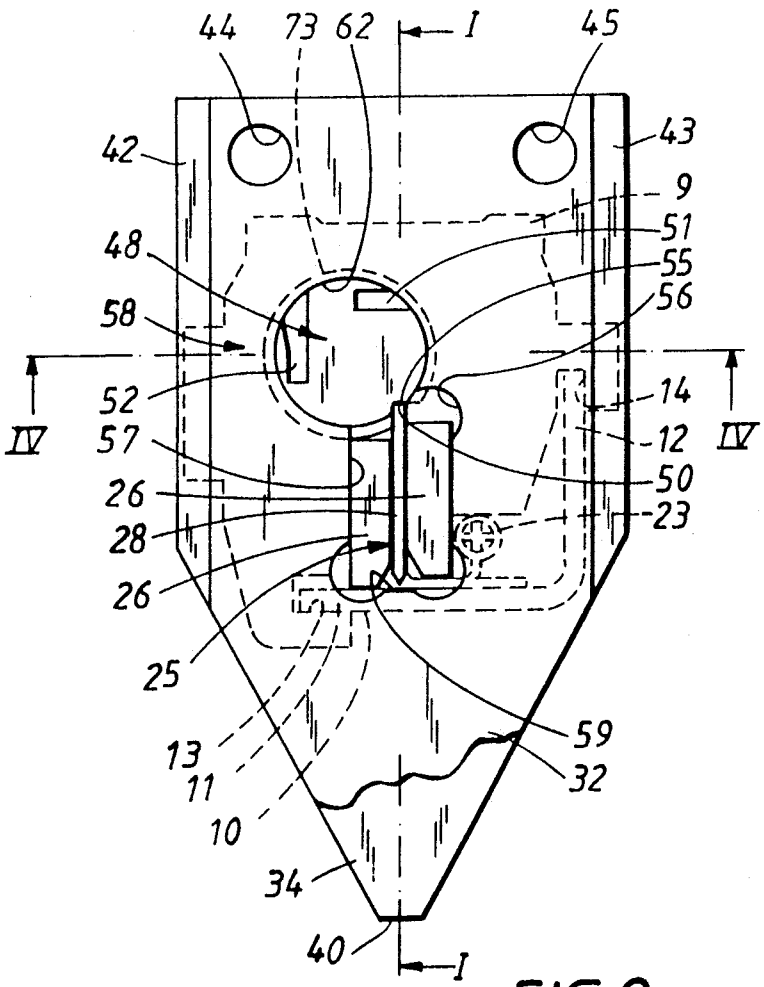
FIG. 2 shows the magazine from the front with the adjustment device in a fixed position.

As shown in FIGS. 2-5, the front nozzle plate 34 is guided in two grooves 42 and 43 in the rear nozzle plate 32. Said rear nozzle plate 32 further presents two screw holes 44 and 45 for the screws 37. For the sake of clarity, the front nozzle plate in FIGS. 2 and 3 is shown partially sectioned.

When the apparatus 1 is to be fired, the leading brad 28 is in the ejector passage 35. When the trigger 4 is squeezed, an impact member 39 is fired with large force through said passage 35 and thereby strikes the impact region 30 of the brad 28, whereby the brad 28 is driven at high velocity through the passage 35 and out through the orifice 40 of the nozzle 7, whereby once the trigger 4 is released, the impact member 39 returns to its position as shown in FIG. 1 and the next brad 28 from the magazine 2 is fed forward into the ejector passage 35.

The magazine 2 is constructed so as to permit selective adaptation to brads 28 of, in the shown embodiment, three different predetermined lengths by means of an adjustment device 47. The adjustment device 47 comprises a body 48 which is substantially cylindrically formed and rotatable about its longitudinal axis. The rotationing body 48 runs in a cylindrical through passage 49 formed in the magazine housing 9. As is clearly shown in FIGS. 2-4, the longitudinal axis of the rotatable body 48 is arranged parallel to, though offset from, the row of fasteners 22 in the feed channel 25. The body 48 further presents, in the shown embodiment, three longitudinally extending slots 50, 51 and 52 of varying depths for accommodating a portion of the present brads 28, more accurately, the impact region 30 of the brads. The body 48 can, with the help of an operating member 52, be rotated to one of said three positions in which the desired slot is aligned with the brads' 28 direction of ejection, as shown in FIG. 2. The body 48 is shown in the figures in a position where the brad 28 lies adjacent the bottom surface 55 of the slot 50. In this position the magazine 2 is adapted for the shortest possible brad 28 and, as such, the slot 50 merely presents a shallow depth. The next, somewhat longer, brad length accordingly corresponds to the somewhat deeper slot 51 and the longest of the three predetermined brad lengths corresponds to the deepest slot 52. From FIG. 2 it can be further seen that the brads 28 together with the guide rails 26 extend through an opening 57 in the rear nozzle plate 32. Hereby it can be seen that the earlier mentioned feed channel 25 is delimited in the direction towards the orifice 40 by both the magazine cover 10 and the side surface 59 of the opening 57. The opening 57 presents three semi-circular corners 56 which simplify the manufacture of the nozzle plate 32. Said feed channel 25 is delimited laterally by the two guide rails 26 as described previously. In the direction towards the handle 5, i.e. upwardly in the figures, the feed channel 25 is delimited by the base surface 55 of the slot 50 in the rotatable body 48.

The body 48 is also displaceable in its longitudinal direction with the help of said operating member 54, whereby the body 40 can be rotated in either direction so that one of the remaining two slots 51 and 52 is aligned with the ejection direction of the brads 28. The body 48 is shown in FIG. 3 during this said rotation. The rotation can only occur when the magazine is not loaded with brads 28 at the same time that the magazine cover 10 is in its open position. In said open position the operating member 54 is accessible by the operator, and in the magazine cover's 10 closed position it is concealed within the end piece 16.

Figure 7:
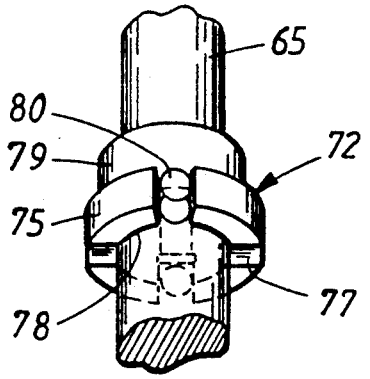
FIG. 7 is a partial perspective view of a part of an operating member according to the invention.
Figure 8:
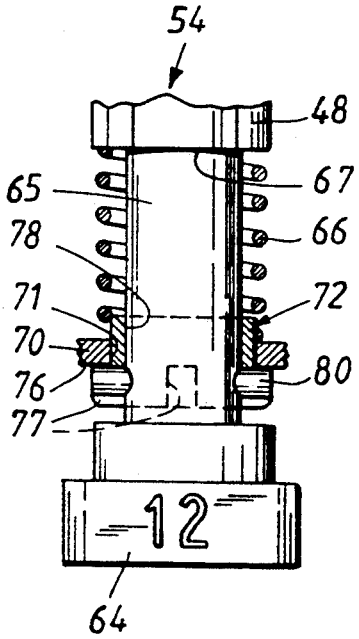
FIG. 8 is a partial sectional view of said operating member in a fixed position.
Figure 9:
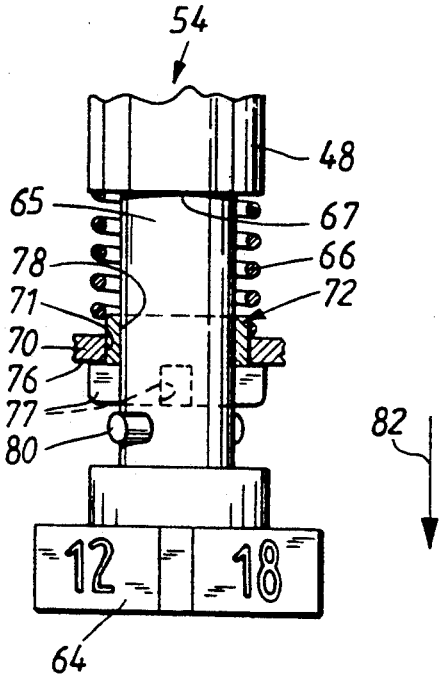
FIG. 9 is a partial sectional view of said operating member during rotation to a different position.

The function and construction of the operating member 54 can be clearly seen from FIGS. 7, 8 and 9. From here it can be seen that the operating member 54 comprises a partially quadratic shaped adjuster knob 64 on the end region 65 of the body 48, which end region is machined down to a smaller diameter than the rest of the body 48. A spiral spring 66 is arranged around the machined down region 65 and abuts against the surface 67 which is formed at the transition between the machined down region 65 and the full diameter part of the body 48, and also against an end plate 70 affixed to the base 69 of the magazine casing 9. The end plate 70 presents a through-hole 79, as shown in the figures, in which hole a position-determining casing 72 surrounding the region 65 of the body 48 is fixedly secured by means of, for example, spot welding. The position-determining casing 72 comprises a relatively thin walled circular through-projecting part 79 which extends through the hole 71, and a wider circular fixation part 75 abutting against the outer surface 76 of the end plate 70. The fixation part 75 present four positioning slots 77 open in the direction towards adjuster knob 64, which slots are pairwise arranged facing each other on opposite sides of a through-hole 78 in the position-determining casing 72. The positioning slots 77 are intended to accommodate a transverse round pin 80 which extends through a machined down portion 65 of the body 48 in such a way that it projects from both sides of said region 65. When the round pin 80 is in engagement with two opposing positioning slots 77, as is the case in FIG. 8, the body 48 is securely located in a position whereat one of the three previously mentioned longitudinally extending slots 50, 51 and 52 is aligned with the ejection direction of the brads 28, as shown in FIG. 2. The round pin 80 is held in the slots 77 by means of the body 48 being biased by the spiral spring 66.

Figure 4:
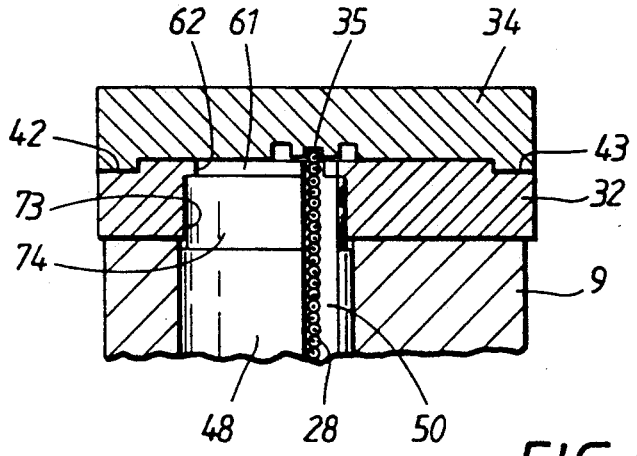
FIG. 4 is a partial cross-section of the magazine along line IV—IV in FIG. 2.

The body 48 is shown in FIG. 4 in a sectional view along line IV—IV of FIG. 2. The body 48 is accordingly in a fixed position. For the sake of clarity, the brads 28 have also been illustrated in position in front of the slot 50 of the body 48. On the ejection side 58 of the magazine 2 the body 48 extends through the rear nozzle plate 32, as shown in the figures. A machined down circular end-stop step 61 is hereby formed at the extreme end of the body 48 which, when the body 48 is fixed in position, engages with a corresponding circular flange-like end-stop 62 formed in the rear nozzle plate 32. In direct contact with the end-stop step 61 there is a bearing surface 74 with which the body 48 is carried in a corresponding bearing seat 73. The opening defined by the end stop 62 in the rear nozzle plate 32 communicates with the previously described opening 57, as shown in FIG. 2.

Figure 5:
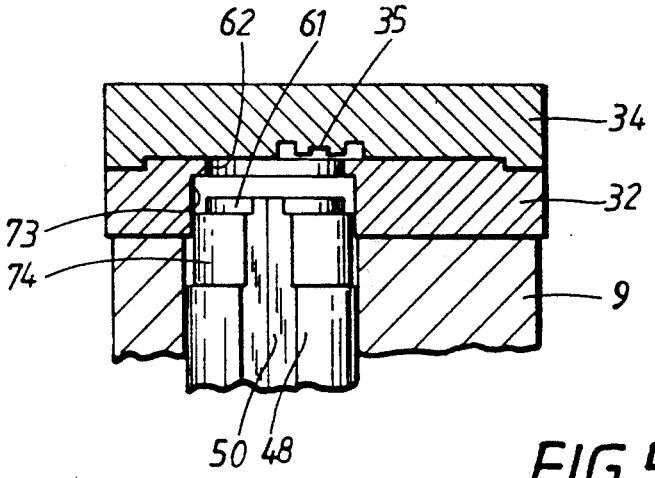
FIG. 5 is a sectional view of the magazine along line V—V in FIG. 3.

For adjustment of the body 48, the magazine cover 10 is extended to its open position whereat the adjustor knob 64 is pulled back in the direction of arrow 82 in FIG. 9, until the round pin 80 is brought out of engagement with the positioning slots 77, whereafter the adjustor knob 64 is turned in the required direction until the desired longitudinally extending slot 50, 51 or 52 is in alignment with the ejection direction of the brads 28 and the round pin 80 is able to engage with corresponding location slots 77. The adjustor knob 64 can advantageously be provided with numbers designating the present brad length corresponding to the said positions. Once the adjustment of the body 48 has been made, the brads 28 can accordingly be placed in the magazine 2 and the magazine cover 10 returned to its closed position whereat the adjustor knob 64 can no longer be seen from the outside. As shown in FIG. 5, the bearing surface 74 remains in contact with the bearing seat 73 during the above-described rotation of the body 48.

Figure 6:
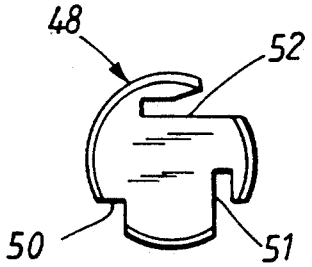
FIG. 6 is a front view of a separate adjustment device according to the invention.

For the sake of clarity, a separate body 48 is shown in FIG. 6 from the end, where the differences in depth of the various slots 50, 51 and 52 are clearly shown.

The present invention is not restricted to the embodiment described above and shown in the drawings, but can be varied within the scope of the appended claims. Such variations are not to be regarded as a departure from the spirit and scope of the invention, and all such modifications as would be obvious to one skilled in the art are intended to be included within the scope of the following claims. For example, the number of slots 50, 51 and 52 can of course be increased.

We claim:

1. Apparatus for ejecting elongated fasteners of predetermined length from a magazine, said apparatus comprising an impact member for striking an impact region on said fasteners, and said magazine comprising;

i) a longitudinally extending feed channel in which a row of said fasteners is arranged, and ii) an adjustment device for selective adaptation of the magazine to rows of fasteners of a plurality of predetermined lengths;

said adjustment device comprising;

a cylindrical body having a longitudinal axis and having two or more longitudinally extending slots of differing depth, the depth of one sot accommodating a portion of the fasteners in said row of fasteners which are arranged in said feed channel, and said cylindrical body being rotatable between positions in which each of said slots are aligned with said row of fasteners in said feed channel;

said slots being arranged in said cylindrical body such that when each slot is aligned with sad row of fasteners, the longitudinal axis of the cylindrical body is offset from said row of fasteners in a manner such that the longitudinal axis of the cylindrical body does not lie directly above the row of fasteners.

2. The apparatus as claimed in claim 1, wherein said longitudinally extending slots accommodate the impact region on said fasteners.

3. The apparatus as claimed in claim 2, wherein three slots are provided in the cylindrical body.

4. The apparatus as claimed in claim 1, wherein said cylindrical body is displaceable in a longitudinal direction by an operating member which is engageable with and disengageable from a position-determining member, whereby said cylindrical body is rotatable upon disengagement of the operating member.

5. The apparatus as claimed in claim 4, wherein said cylindrical body has a transversely extending pin, and said position-determining member comprises a position-determining casing having a plurality of positioning grooves arranged to accommodate said transversely extending pin to thereby fix said body in a position in which a desired one of said slots is aligned with the row of fasteners.

6. The apparatus as claimed in claim 5, wherein said pin is maintained in one of said positioning grooves by a spring.

7. The apparatus as claimed in claim 5, wherein three slots are provided in the cylindrical body.

8. The apparatus as claimed in claim 6, wherein three slots are provided in the cylindrical body.

9. The apparatus as claimed in claim 4, wherein three slots are provided in the cylindrical body.

10. The apparatus as claimed in claim 1, wherein three slots are provided in the cylindrical body.

* * * * *